US007168820B1

(12) United States Patent
Minassian

(10) Patent No.: US 7,168,820 B1
(45) Date of Patent: Jan. 30, 2007

(54) LIGHTED VASE

(76) Inventor: Djirair Minassian, 539 N. Jackson St., Glendale, CA (US) 91206

( * ) Notice: Subject to any disclaimer, the term of this patent is extended or adjusted under 35 U.S.C. 154(b) by 59 days.

(21) Appl. No.: 11/020,951

(22) Filed: Dec. 21, 2004

(51) Int. Cl.
*F21V 33/00* (2006.01)

(52) U.S. Cl. ..... 362/101; 362/96; 362/551

(58) Field of Classification Search ..... 362/101, 362/96, 155, 194, 805, 551, 34; 206/217
See application file for complete search history.

(56) References Cited

U.S. PATENT DOCUMENTS 5,879,068 A * 3/1999 Menashrov et al. ..... 362/101

6,511,196 B1 * 1/2003 Hoy ..... 362/101

* cited by examiner

*Primary Examiner*—Sandra O'Shea
*Assistant Examiner*—Guiyoung Lee
(74) *Attorney, Agent, or Firm*—Jack C. Munro; Sandy Lipkin

(57) ABSTRACT

A lighted vase which utilizes a base on which is mounted a container with the container having an internal chamber which is open at its outer end. The base includes a cavity and mounted in the cavity is a light generator. The structure of the container and the base is of a rigid material which is capable of conducting light. Light from the light generator, when activated, is to be transmitted through both the base and the container.

6 Claims, 1 Drawing Sheet

LIGHTED VASE

BACKGROUND OF THE INVENTION

1. Field of the Invention

The subject matter of this invention is directed to vases which have an internal chamber which is adapted to receive an exterior structure such as flowers.

2. Description of the Related Art

A vase is generally defined as a vessel which is usually constructed of glass, porcelain, earthenware or metal and which has a configuration which is usually higher than it is wide. The vase is used chiefly to hold cut flowers or for supporting other types of decoration, such as silk flowers.

In the past, there have been constructed vases of many different configurations. Almost all vases are tall, that means that it is greater in height than in width. Glass vases are capable of conducting light but most such vases do not include a light generator which is internally mounted.

SUMMARY OF THE INVENTION

The basic embodiment of the present invention comprises a lighted vase which has a base with this base being constructed of a rigid, translucent material capable of conducting light. The base has a top surface and a bottom surface with there being a container attached to the top surface. The container is formed of a rigid, translucent material capable of conducting light and the container has an internal chamber which is capable of receiving an exterior structure. A cavity is formed in the bottom surface of the base with the cavity having an inner wall which is oriented transverse or across the base. The inner wall can have either an arcuate or planar configuration. The container is attached to the top surface directly adjacent this inner wall. The container has a top portion and a bottom portion. The bottom portion is slightly smaller in dimension than the top surface of the base. A light generator is located within the cavity formed in the bottom of the surface of the base. Activation of the light generator is to produce light that causes light to be conducted through the base and the container. The light generator is activated by moving a manual switch in a pre-determined direction.

A further embodiment of the present invention is where the basic embodiment is modified by having both the base and container being constructed of glass.

A further embodiment of the present invention is where the basic embodiment is modified by having the container being integrally mounted to the base.

A further embodiment of the present invention is where the basic embodiment is modified by defining that the internal chamber has an open upper end.

A further embodiment of the present invention is where the basic embodiment is modified by defining that the light generator is adhesively secured to the inner wall.

A further embodiment of the present invention is where the basic embodiment is modified by the light generator being defined as being battery operated and the light is to be activated by means of operation of a manual switch.

BRIEF DESCRIPTION OF THE DRAWING

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
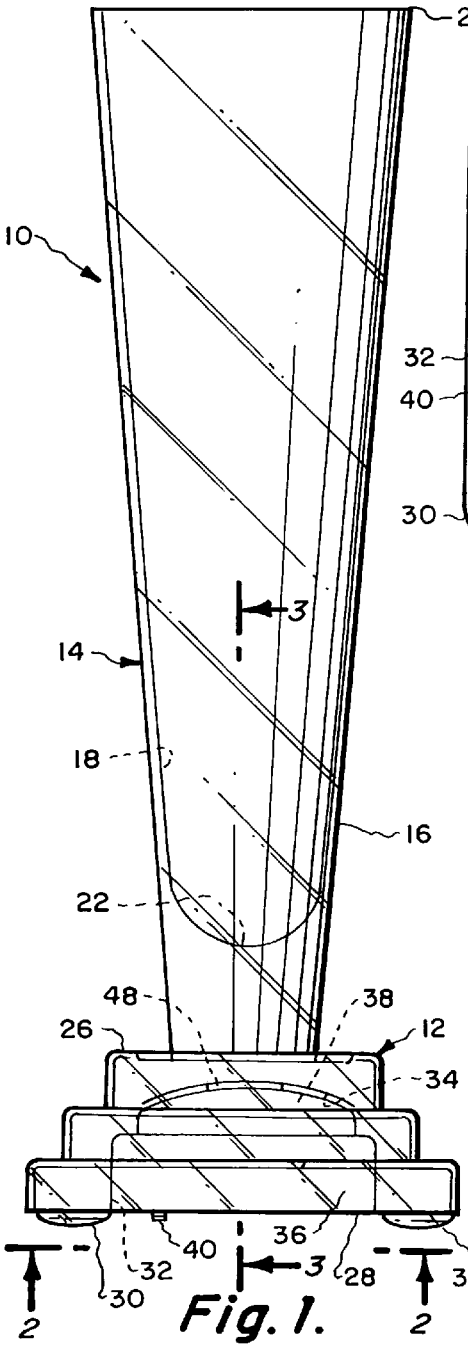
FIG. 1 is an exterior view of the lighted vase of the present invention.
Figure 2:
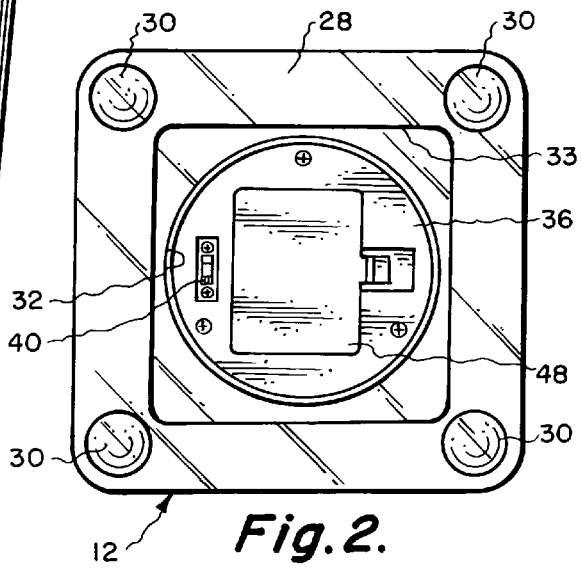
FIG. 2 is a bottom view of the base of the lighted vase of the present invention taken along line 2—2 of FIG. 1.
Figure 3:
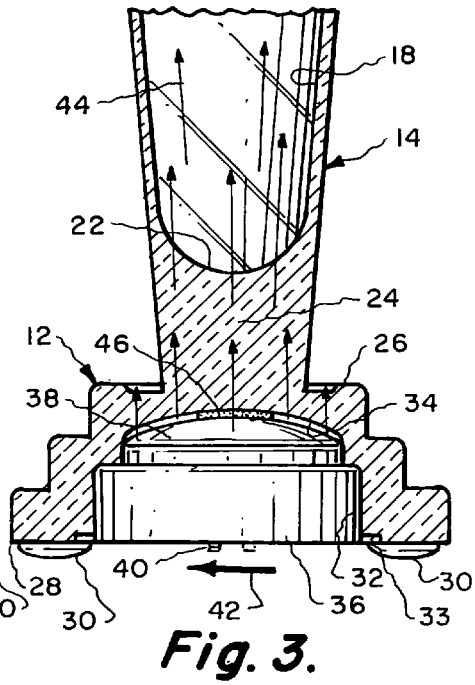
FIG. 3 is a cross-sectional view through the base and a portion of the container of the lighted vase of the present invention taken along line 3—3 of FIG. 1.

Referring particularly to the drawing, there is shown the lighted vase 10 of this invention that is capable of holding exterior objects such as flowers. The lighted vase 10 includes a base 12 and a container 14. Both the vase 12 and the container 14 are designed to be composed of a translucent material that is capable of conducting light. A typical material would be glass although it is within the scope of this invention that the material could be a plastic. The container 14 is integrally connected to the base 12. Both the base 12 and the container 14 are capable of conducting light.

The container 14 is formed of a sidewall 16 which surrounds an internal chamber 18. Container 14 has an upper end 20. At the upper end 20 the internal chamber 18 is open to the ambient. Generally, the container 14 will be constructed to be longitudinally tapered in configuration, which is clearly shown in FIG. 1. However, such a tapering configuration is not mandatory. The internal chamber 18 terminates at a lower end 22 which connects with a solid block 24. The solid block 24 is integrally connected to the top surface 26 of the base 12. The lower end 22 of the container 14 is slightly smaller in dimension than the top surface 26 of the base 12.

The base 12 also has a bottom surface 28. Formed in the bottom surface 28 is a shallow rectangularly shaped recess 33 which surrounds the entry to the cavity 32. Mounted on the bottom surface 28 are a plurality of resilient footpads 30 with there generally being four in number of the footpads 30. Formed within the base 12 through the bottom surface 28 is a cavity 32. The cavity 32 has an inner wall 34 which is located transverse across the base 12 directly adjacent the solid block 24. The inner wall 34 is shown to be of an arcuate configuration. However, although this arcuate configuration is preferred it is considered to be within the scope of this invention that the inner wall could be planar.

A light generator 36 is formed in the shape of a basically cylindrical configuration which has mounted therein on its upper surface a lens 38. Incorporated in conjunction with the light generator 36 is a battery and a light source, which generally would be a light bulb, which are not shown. Such a battery and light source are deemed to be conventional. Activation of the battery to emit light is accomplished by manually moving of switch 40 in the direction of arrow 42. It is to be understood that in order to deactivate the light being emitted from the light source, it is only necessary to move the switch 40 in a direction opposite of arrow 42. The light that is emitted from the light generator 36 is depicted in the direction of arrows 44. The result is the light that is emitted is to be conducted through the base 12 and through the container 14 producing a most desirable ornamental effect. This can be accentuated by the including of an exterior structure, which is not shown, within the internal chamber 18 of the container 14. A typical exterior structure would be cut flowers or silk flowers.

It is desirable that the light generator 36 be fixedly mounted within the cavity 32. This is accomplished by the including of a light conducting (transparent) adhesive 46 on the inner wall 34. The adhesive 46 forms a bond between the inner wall 34 and the light generator 36 securing same within the cavity 32.

The light generator 36 includes a removable access panel 48 formed on its bottom surface. The access panel 48 provides entry into the batteries contained within the light generator 36. The access panel 48 permits the changing of those batteries and also the changing of the light bulb contained therein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A lighted vase for the display of items such as flowers or other exterior structures, comprising:

a base, said base being constructed of a rigid, translucent material capable of conducting light, said base having a top surface and a bottom surface;

a cavity formed in said bottom surface of said base, said cavity having an inner wall which is oriented transverse relative to said base, said inner wall having an arcuate configuration;

a container attached to said top surface said container having a top portion and a bottom portion, said container being directly adjacent said inner wall, said bottom portion of said container being slightly smaller in dimension than said top surface of said base, said container formed of a rigid, translucent material capable of conducting light, said container having an internal chamber which is capable of receiving an exterior structure; and a light generator being located within said cavity formed in said bottom surface of said base, activation of said light generator to produce light causes light to be conducted through said base and said container, said light generator being battery operated, activation of said light generator being accomplished by the moving of a manual switch in a pre-determined direction.

2. The lighted vase as defined in claim 1 wherein both said base and said container are constructed of glass.

3. The lighted vase as defined in claim 1 wherein said container is integral to said base.

4. The lighted vase as defined in claim 1 wherein said container has a free end, said internal chamber being open at said free end.

5. The lighted vase as defined in claim 1 wherein said light generator is adhesively secured to said inner wall.

6. The lighted vase as defined in claim 1 wherein said inner wall has a planar configuration.

* * * * *